US007966788B2

(12) United States Patent
Rütter

(10) Patent No.: US 7,966,788 B2
(45) Date of Patent: Jun. 28, 2011

(54) METHOD AND DEVICE FOR PACKAGING PRODUCT PORTIONS IN A WRAPPER

(75) Inventor: Karl Josef Rütter, Pulheim (DE)

(73) Assignee: Benz & Hilgers GmbH, Neuss (DE)

( * ) Notice: Subject to any disclaimer, the term of this patent is extended or adjusted under 35 U.S.C. 154(b) by 253 days.

(21) Appl. No.: 12/385,813

(22) Filed: Apr. 21, 2009

(65) Prior Publication Data

US 2009/0266033 A1 Oct. 29, 2009

(30) Foreign Application Priority Data

Apr. 24, 2008 (DE) ..... 10 2008 020 604

(51) Int. Cl.
*B65B 43/10* (2006.01)
*B65B 47/06* (2006.01)
*B65H 39/16* (2006.01)

(52) U.S. Cl. ..... 53/452; 53/389.2; 53/450; 53/453; 53/456; 53/553; 53/559; 53/563; 493/235; 493/239; 493/344; 226/172; 270/52.08

(58) Field of Classification Search ..... 53/122, 53/171, 450, 452, 453, 456, 529, 553, 559, 53/561, 563, 568, 389.2; 493/227, 231, 235, 493/239, 344, 361, 362, 243, 250, 356, 357, 493/446, 449, 455; 226/108, 91, 118.2, 118.3, 226/171, 172; 242/525, 525.5–525.7; 270/5.02, 270/52.09, 52.08
See application file for complete search history.

(56) References Cited

U.S. PATENT DOCUMENTS 2,297,432 A * 9/1942 Rasch et al. ..... 53/464
2,790,594 A * 4/1957 Hultkrans et al. ..... 229/87.05
3,265,271 A * 8/1966 Cohn et al. ..... 226/177
3,266,214 A * 8/1966 Kramme ..... 53/122
4,011,975 A * 3/1977 Brown, Jr. ..... 226/2
4,058,953 A * 11/1977 Sanborn et al. ..... 53/433
4,120,984 A * 10/1978 Richardson et al. ..... 426/412
4,491,309 A * 1/1985 Beckley ..... 270/20.1
4,542,893 A * 9/1985 Clause, Jr. et al.
4,738,074 A * 4/1988 Invernizzi et al.
5,009,137 A * 4/1991 Dannatt
5,379,574 A * 1/1995 Fischer et al.
5,501,065 A * 3/1996 Fischer et al.

(Continued)

FOREIGN PATENT DOCUMENTS

CH 514 475 12/1971

(Continued)

*Primary Examiner* — Rinaldi I Rada
*Assistant Examiner* — Gloria R Weeks
(74) *Attorney, Agent, or Firm* — Paul Vincent

(57) ABSTRACT

A method and a device for packaging product portions in a wrapper are proposed, wherein at least two webs of a packaging material are aligned parallel, with the longitudinal edges facing each other overlapping, and each transported towards one upwardly open folding shaft, the webs are severed transverse to the overlapping longitudinal edges, creating flat blanks of the wrappers, and the blanks are folded into the folding shaft , creating an upwardly open wrapper, whereupon the product portion is placed in the open wrappers and the upwardly protruding sections of the wrappers are then turned inward while overlapping. The blanks, whose inner edges overlap, are guided in frictional engagement to their folding position above the folding shafts, whereupon the longitudinal edges of the overlapping blanks facing each other are, lifted together , whereupon the blanks are released by releasing the frictional engagement.

26 Claims, 3 Drawing Sheets

U.S. PATENT DOCUMENTS

| | | | | |
|---|---|---|---|---|
| 5,511,500 | A | * | 4/1996 | Conley, Jr. |
| 5,794,411 | A | | 8/1998 | Combs |
| 5,833,107 | A | * | 11/1998 | Terranova et al. |
| 6,364,305 | B1 | * | 4/2002 | Sussmeier et al. |
| 6,391,157 | B1 | * | 5/2002 | Elger |
| 6,539,688 | B2 | * | 4/2003 | Fahs et al. |
| 6,708,466 | B2 | * | 3/2004 | Spatafora |
| 6,904,738 | B2 | * | 6/2005 | Spatafora et al. |
| 7,302,786 | B2 | * | 12/2007 | Oleandri et al. |

FOREIGN PATENT DOCUMENTS

| | | |
|---|---|---|
| DE | 866 171 | 2/1953 |
| DE | 28 23 026 | 11/1979 |
| DE | 42 13 555 | 7/1993 |
| DE | 100 00 297 | 7/2001 |
| DE | 101 00 085 | 7/2002 |
| DE | 102 48 231 | 4/2003 |
| DE | 103 30 725 | 1/2005 |
| EP | 1 495 972 | 1/2005 |

* cited by examiner

METHOD AND DEVICE FOR PACKAGING PRODUCT PORTIONS IN A WRAPPER

This application claims Paris Convention priority of DE 10 2008 020 604.0 filed Apr. 24, 2008 the complete disclosure of which is hereby incorporated by reference.

BACKGROUND OF THE INVENTION

The invention concerns a method for packaging product portions in a wrapper, wherein at least two webs of packaging material are aligned essentially parallel, with the longitudinal edges facing each other overlapping, and are each transported towards an upwardly open folding shaft, the webs are severed transverse to the overlapping longitudinal edges, creating substantially flat blanks of the wrappers, and the blanks are folded into the folding shaft by means of a folding stamp inserted into the folding shaft, creating an upwardly open wrapper, whereupon the product portion is placed on the upwardly open wrappers and the upwardly protruding sections of the wrappers are turned inward. The invention further concerns a device suitable in particular for using such a method for packaging product portions in a wrapper, having at least two parallel, upwardly open folding shafts, to each of which a folding stamp, insertable into the respective folding shafts, is allocated, with an adjusting unit structured and disposed to align at least two webs of a packaging material substantially parallel, with the two longitudinal edges facing each other overlapping, with a cutting device acting transverse to the longitudinal edges of the webs, and with a transport device structured and disposed to transfer the web blanks created by means of the cutting device to the folding shafts.

Methods and devices of the above-mentioned kind are known and widely used in particular for portioned packaging of more or less paste-like foods such as butter, margarine, paste-like fats, processed and fresh cheese, chocolate, soup pastes, and the like. The process usually involves initially creating flat blanks from a running web of packaging material. The blanks then run over two parallel folding shafts. A folding stamp pulls the blank through the folding shaft, wherein the folding stamp and/or the folding shaft are equipped with appropriate guiding devices for creating the folds and for overlapping the sections of the blank which are to be placed on top of each other. This method creates a wrapper which is only upwardly open, which can subsequently be placed in a cell, for example, where the wrapper is then filled with the product portion. Finally, the upwardly protruding lateral parts of the wrapper are folded inward onto the open side of the product. Methods and devices for packaging paste-like products in such a way are known, for example, from DE 101 00 085 A1 and DE 103 30 725 A1.

It is usually desirable to dispose the folding shafts as closely together as possible. This is for reasons of space to ensure that the device is as compact as possible and that routes of transport of the packaging material and/or of the wrapper pre-folded in the folding shafts, which are needed for the very short cycle times and therefore the efficiency of modern packaging devices, are short. Furthermore, the folding shafts are often disposed in the peripheral area of a carousel, which forwards the wrappers which have been pre-folded in the folding shafts and can be placed in cell-like cavities, for example, to downstream stations which are also disposed in the peripheral area of the carousel, such as a filling station, a plying station to fold those sections of the wrapper that protrude upwardly over the portioned product, a removal station for the finished packages, etc.

For this reason, it is known to feed a broad web of packaging material to the two folding shafts in such a way that the web of packaging material extends across both folding shafts, whereupon it is severed in a transverse manner, creating a wide blank. Before it is folded into the folding shafts, the central section of this blank from the web of packaging material, which is located between the folding shafts, is lifted by means of folding stamps which are inserted into the folding shafts from above so that its two outer longitudinal edges are pulled inside to place the folding shafts as closely together as possible. Once the blank has reached its desired position relative to the folding shafts by pulling its edges inside accordingly as a result of the central lifting of the blank, the blank is severed lengthwise centrally, creating the two wrappers to be folded, which is done, for example, by means of a blade disposed at the lifting device. The wrappers are then folded into the folding shafts by means of the folding stamps, and the pre-folded, upwardly open wrappers are supplied to further processing stations (filling etc.). It is particularly unfavorable that the packaging material cannot always be aligned accurately over the two folding stamps, in particular when cycle times are very high, and that aligning the wide blank of packaging material by lifting it centrally also causes relatively high stress on the material, so that the method is not suitable for all packaging materials, in particular those with a relatively low resistance to tearing.

It is further known to align two webs of packaging material relative to each other in such a way that the longitudinal edges facing each other overlap. This is achieved by central, lengthwise severing of a wide web of packaging material to form two parallel webs and by guiding one of the two webs over traversing rollers directly upstream of the folding shafts to move it towards the other web parallel to it. The webs are then severed in transverse manner, creating blanks for the wrappers, and the blanks are folded into the folding shafts by means of the folding stamps. Furthermore, guide bars are disposed which support the longitudinal edges of the webs and/or blanks opposite to each other to ensure exact alignment of the two webs relative to each other. In this case, primarily the complex structure of the device required due to the necessary traversing roller is unfavorable, as is the fact that the device can in particular not, or only with difficulty, be adjusted to different formats of packaging material.

Against this background, the invention is based on the task of further developing a method and a device of the above-mentioned kind in a simple and cost-effective manner so as to avoid the above-mentioned disadvantages to the greatest possible extent.

SUMMARY OF THE INVENTION

As regards the processing technique for a method of the above-mentioned kind, this task is solved by feeding the blanks, whose longitudinal edges facing each other overlap, in frictional engagement to their folding position above the folding shafts, whereupon the longitudinal edges of the overlapping blanks facing each other are lifted together at least to a level where the loose ends of the longitudinal edges of the blanks facing each other are outside of the area of their respective neighboring folding shafts, whereupon the blanks are released by releasing the frictional engagement, and the blanks are then folded into their respective folding shafts by means of the folding stamps.

As regards the device of the above-mentioned kind, the invention solves this task by equipping the transport device with two parallel guiding devices spaced apart in a transverse direction, each of which comprises two guiding means disposed on top of each other, structured and disposed to accommodate the blanks in frictional engagement between them and for releasing them, and by providing a lifting means between the folding shafts, which is structured and disposed to support the overlapping longitudinal edges of the blanks facing each other, wherein the lifting means can be shifted between a lower position below these longitudinal edges and a respectively higher position.

Favorable embodiments of the invention are given in the dependent claims.

The invention allows exceptionally secure guiding of the webs of packaging material by grasping, in particular clamping, their blanks, for example in the area of the longitudinal edges facing each other, in frictional engagement and thus transferring them accurately to their designated folding position above the folding shafts without having to shift them there again in a transverse or lengthwise manner. Due to the fact that the overlapping sections of both webs facing each other are lifted, the folding shafts can be disposed very closely to each other, in particular so closely to each other that either of the webs overlaps with the other web in such a way that it protrudes as far as below the neighboring folding shaft or even beyond it before its longitudinal edge facing the other web is lifted. At the same time, the guiding in frictional engagement safely prevents lateral displacement of both webs towards the inside or the outside when they are lifted on one (the inner) side. Finally, the invention also makes it possible to process webs of packaging material with different formats, since the guiding in frictional engagement need not necessarily make contact with a particular section of the respective webs as long as it makes contact with the respective webs at the exterior (i.e. at the sides of the folding shafts), and further lengthwise guiding means are unnecessary, and since in particular the degree of overlapping is largely variable because the latter merely requires adjusting the lifting distance when lifting the loose ends of the two blanks of packaging material facing each other.

Further features and advantages of the invention will become apparent from the following description of an embodiment with reference to the drawings, wherein:

DESCRIPTION OF THE PREFERRED EMBODIMENT

Figure 1:
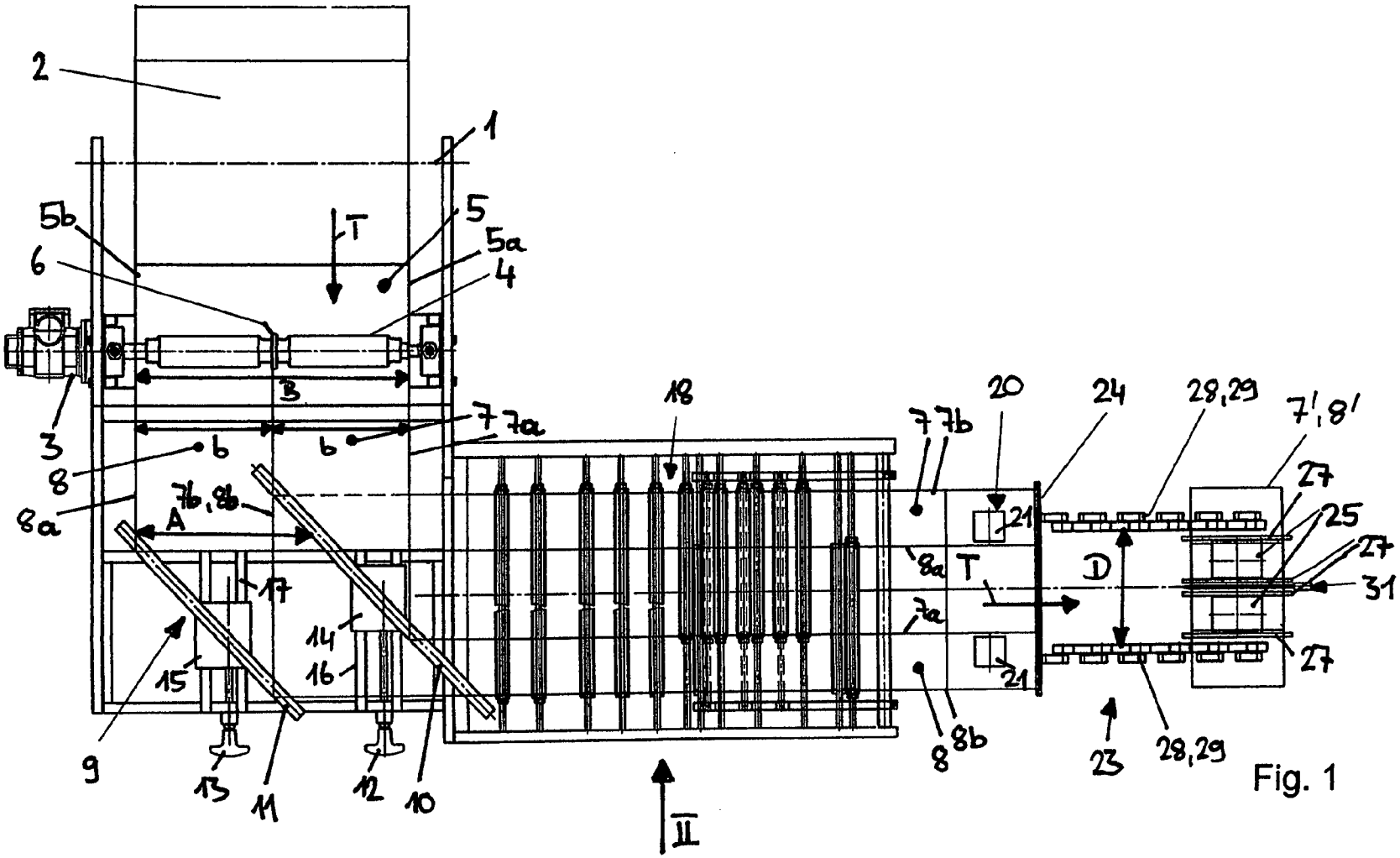
FIG. 1 shows a top view of an embodiment of a device in accordance with the invention for packaging paste-like product portions in a wrapper.
Figure 2:
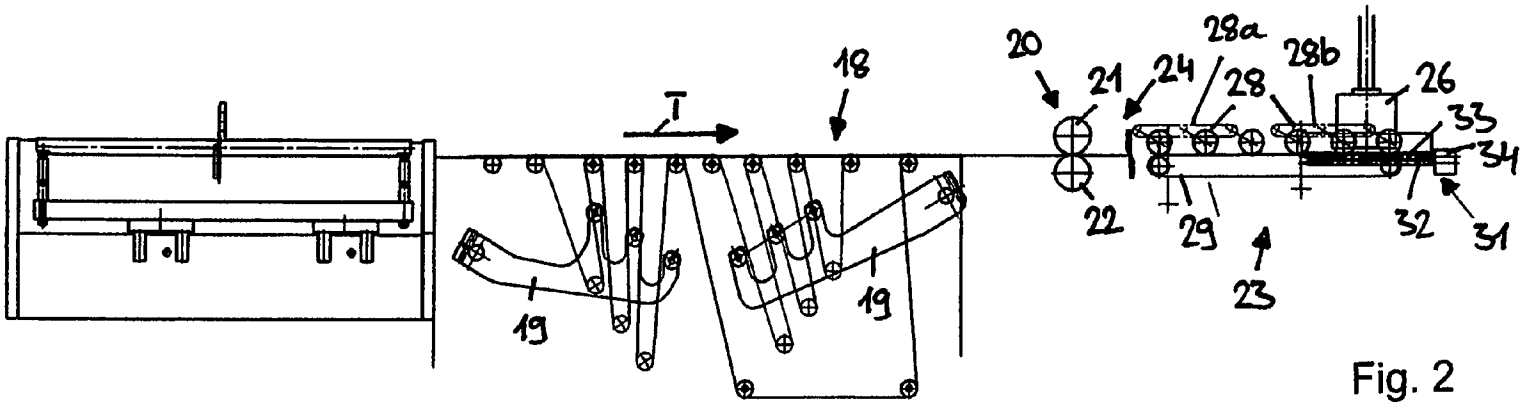
FIG. 2 shows a side view of the device seen in the direction of arrow II as shown in FIG. 1.

As is apparent in particular from FIGS. 1 and 2, the device for packaging paste-like product portions in a wrapper comprises a carrying axle 1, which serves to accommodate the roll 2 of packaging material disposed in layers, which can consist of conventional packaging material, for example foil or multilayer foil material. A take-off roller 4, which can be set in controlled rotation by means of a motor 3 and serves to unwind the web of packaging material 5 from the roller 2, is disposed downstream of the carrying axle 1 in the direction of transport T of the packaging material and coaxially to the carrying axle 1. A cutting device 6 acting lengthwise, i.e. parallel to the longitudinal edges 5*a*, 5*b* of the web of packaging material 5, which is configured in the present embodiment as a blade disposed at a central point of the take-off roller 4, which may, for example, be rotating, serves to sever the web of packaging material 5 lengthwise, creating two parallel webs 7, 8, whose width b corresponds, for example, to half the width of the web of packaging material 5 before the severing process.

Seen in the direction of transport T, an adjusting unit 9, which is structured and disposed to align the two parallel webs 7, 8 of packaging material so that they remain parallel to each other but the longitudinal edges facing each other 7*a*, 8*a* overlap, immediately follows the take-off roller 4 and the cutting device 6. The adjusting unit 9 preferably has deflecting axles 10, 11 allocated to the webs 7, 8, respectively, which are disposed parallel to each other and at a discrete angle—about 45° in this case—to the longitudinal edges of the webs 7, 8, so that both webs 7, 8, each of which is guided over one of the deflecting axles 10, 11 are deflected by an angle—about 90° in this case. The deflecting axles 10, 11 are disposed at such a distance A, transverse to the direction of transport T of the webs 7, 8 running towards them (from above in FIG. 1), that the longitudinal edges facing each other 7*a*, 8*a* in the deflected webs 7, 8 overlap downstream (on the right hand side in FIG. 1) of the deflecting axles 10, 11. Furthermore, the distance A between the deflecting axles 10, 11 is adjustable to enable changing the alignment of the webs 7, 8 relative to each other, i.e. the degree of their overlap, for example to accommodate the processing of different widths of webs of packaging material. The distance between the deflecting axles 10, 11 can be adjusted, for example, by means of adjusting screws 12, 13, which act in combination with a slide 14, 15 to which the deflecting axles 10, 11 are fixed in such a way that the respective slides 14, 15 are shifted along the guides 16, 17 when the adjusting screws 12, 13 are turned, wherein the guides 16, 17 may, for example, run parallel to the webs of packaging material 7, 8 (supplied from above in FIG. 1). The deflecting axles 10, 11 may consist of rods or other equivalent deflecting means.

Seen in the direction of transport T of the webs 7, 8, a packaging material buffer 18 is disposed downstream of the adjusting unit 9, which, as can in particular be seen in FIG. 2, comprises several deflecting rollers, some of which run on bearings attached to carriers 19 pivoting about a horizontal axis, to enable short-term and in particular intermittent accumulation and swift release by section of the webs of packaging material 7, 8. Such packaging material buffers are known as such and do therefore not require detailed description in the present context.

Further downstream of the packaging material buffer 18, an advance means or conveyor 20 is disposed for the webs 7, 8, which, in the embodiment shown, comprises two rollers 21, 22 operated in an opposite direction (cf. also FIG. 2). Each pair of rollers 21, 22 accommodates one of the webs 7, 8 between them, preferably while exerting pressure on them. The rollers 21 and/or 22 of each web 7, 8 are operated in such a controlled manner that they can be synchronized and are able to transfer the webs 7, 8, in particular by section, to a transport device 23, which will be described in more detail below. Furthermore, they can advantageously be made of or coated with material with a high static coefficient of friction, for example rubber. A cutting device 24 acting transverse to the longitudinal edges 7*a*, 7*b*, 8*a*, 8*b* of the webs 7, 8, whose separating line runs across both webs 7, 8, is disposed downstream of the conveyor 20 and upstream of the transport device 23 to cut the webs 7, 8 into substantially flat blanks of the wrappers.

The transport device 23, which is preferably disposed immediately downstream of the cutting device 24 acting transverse to the longitudinal edges 7*a*, 7*b*, 8*a*, 8*b* of the webs 7, 8, serves to transfer the blanks of the wrappers, created from the webs 7, 8 by means of the cutting device 24, to two folding shafts 25, which are placed next to each other, in particular as closely as possible, transverse to the direction of transport T of the webs 7, 8, and are upwardly open and into each of which a folding stamp 26 (FIG. 2) can be inserted to fold the blanks into the folding shaft 25, creating one upwardly open wrapper each. One blank of the webs 7, 8, marked with the reference signs 7', 8', is indicated in each of the FIGS. 1, 3, and 4 in its folding position above the folding shafts 25. The position of the folding shafts 25 relative to the webs 7, 8—or more precisely: their blanks 7', 8'—is selected so as to ensure that each folding shaft 25 is disposed below the central section of the respective blanks 7', 8'. Further stations (not shown) can follow the folding shafts 25, such as a filling station for filling the folded, upwardly open wrappers with the product to be packaged, a plying station to fold the upwardly protruding sections of the wrapper over the paste-like product while completely wrapping the product, a removal station for the finished packs, etc. Like the folding shafts 25 themselves, these stations can, for example, be disposed around the periphery of a carousel (also not shown), by means of which the wrappers can be supplied to the different stations and carried on from there. Furthermore, so-called pre-folders 27, which are known as such (cf. in particular FIG. 5) may be allocated to the folding shafts 25, and are formed in the present embodiment by folding sheets which run along and parallel to both longitudinal edges of the folding shafts 25 and are advantageous for producing the designated folding lines of the wrapper in a defined manner.

The transport device 23 has two parallel guiding devices spaced apart in a transverse direction, each of which comprises two guiding means 28, 29 disposed on top of each other, which are structured and disposed to frictionally engage between them the blanks of the webs 7, 8, created by means of the cutting device 24, and release them. Their separation D transverse to the direction of transport T (FIG. 1) is in particular selected in such a way that each guiding device accommodates only one of the blanks of the webs 7, 8, whose longitudinal edges facing each other overlap, wherein they are at any rate disposed outside of the folding shafts 25. In the present embodiment, one of the guiding means 28, 29—in this case the lower guiding means 29—is formed by a circulating conveyor belt, which may advantageously be made of or coated with a material with a high static coefficient of friction, such as rubber or the like. The other—in this case the upper guiding means 28—has several consecutive conveyor rollers disposed in the direction of transport T in this embodiment, which run along the entire length of the transport device 23, and in particular as far as the region laterally outside of the folding shafts 25. The same applies to the belt-like guiding means 29. Of course, it is also conceivable as an alternative that both guiding means are formed by conveyor belts or roller configurations or different guiding means which are suitable for accommodating the blanks of the webs of packaging material 7, 8 in frictional engagement and transferring them to the folding shafts 25. The guiding means 28, 29 may either both be operated in controlled synchronization, or only one of the guiding means 28, 29 may be operated in a controlled manner, for example the lower one, guiding means 29, which is disposed as a conveyor belt in this embodiment, while the other one, for example the upper one, guiding means 28, which is disposed as a roller configuration in this embodiment, is passive, i.e. the rollers are set in rotation only by contact, preferably while exerting pressure in the direction of the driven conveyor belt of the guiding means 28.

The guiding means 28, 29 can be shifted towards each other and away from each other, so that the blanks 7', 8' can be clamped between the guiding means 28, 29, conveyed while clamped, and accommodated between them and/or released, so that the blanks 7', 8' of the webs 7, 8, which have been transferred by the conveyor 20 and cut into sections by means of the cutting device 24, can be frictionally engaged and then released. In the present embodiment, this is ensured, for example, by one of the guiding means 28, 29—in this case the lower guiding means 29 disposed as a belt—being stationary, i.e. disposed at a fixed level, while the other guiding means—in this case the upper guiding means 28 with the roller configuration—can essentially be vertically shifted between a gripped position, in which it sits closely against the carrying run of the conveyor belt of the lower guiding means 29, and a release position, in which it is spaced apart from this guiding means 29. As can be seen in particular from FIGS. 2 and 5, the embodiment shown further envisions that the vertically shiftable—in this case upper—guiding means 28 comprises two consecutive sections 28*a*, 28*b*, disposed one behind the other in the direction of transport T, each of which can be shifted separately, so that it is possible to grip two blanks 7', 8' of the webs 7, 8, which have been transferred by the conveyor 20 and cut into sections by means of the cutting device 24, while releasing two blanks 7', 8', located downstream and already being in their folding position above the folding shafts 25, to be folded into the folding shafts 25 by inserting the folding stamp 26 into the folding shafts 25. The sections 28*a*, 28*b* of the guiding means 28 are each formed, for example, by an essentially vertically shiftable carrier, to each of which several—in this case three—of the consecutive rollers is attached. As can be seen from FIG. 5, the shifting of the guiding means 28 and/or its sections 28*a*, 28*b* towards the other guiding means 29 and away from it can, for example, be done by means of piston/cylinder units 30 or in any other manner.

Figure 4:
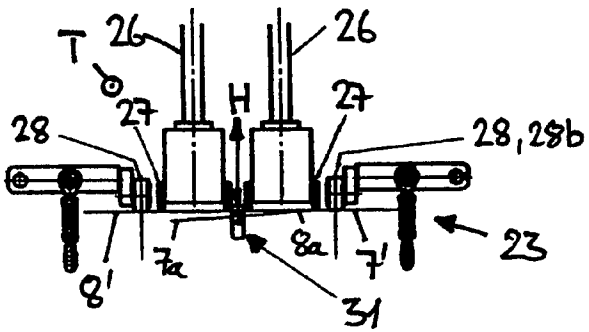
FIG. 4 shows a detailed view of the area of the folding shafts of the device seen in the direction of arrow IV as illustrated in FIG. 3.
Figure 3:
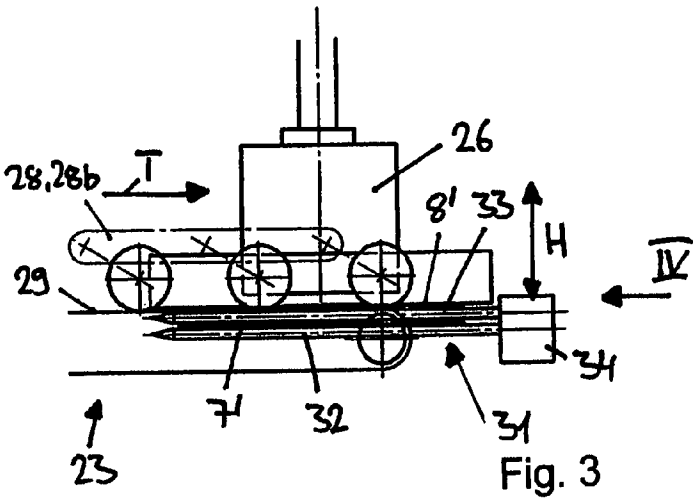
FIG. 3 shows a detailed view of the area of the folding shafts of the device as illustrated in FIG. 2.

As can be seen in particular from FIG. 3, a lifting means 31 is disposed between the folding shafts 25 which is designed to support the overlapping longitudinal edges facing each other 7*a*, 7*b* in the blanks 7', 8' and can be shifted between a lower position below the longitudinal edges 7*a*, 7*b* of the blanks 7', 8', shown in FIGS. 2 to 4, and a respectively higher position, wherein the lifting distance of the lifting means 31 is indicated by the reference symbol H in FIGS. 3 and 4. The lifting distance H of the lifting means 31, which can in particular be pre-set, should be calculated so as to allow for the overlapping longitudinal edges 7*a*, 8*a* of the blanks 7', 8' to be lifted high enough to ensure that at least that—lateral—area of them no longer protrudes as far as below the neighboring folding stamp 26 and/or above the neighboring folding shaft 25 (see in particular FIG. 4). In this embodiment, the lifting means 31 has two separate supporting surfaces—disposed on top of each other in this case—to each of which one of the overlapping longitudinal edges facing each other 7*a*, 8*a* in the blanks 7', 8' can be fed, ensuring particularly high cycle times of the device. Thereby, the lateral areas of the blanks 7', 8' can be supported and lifted individually, i.e. virtually without coming into contact with each other, so that friction between the blanks 7', 8' during the lifting process H, which could affect cycle times, is reliably avoided. The lifting means 31 can in particular be essentially disposed as rods, wherein the rods 32, 33 (see in particular FIG. 3) may run parallel to the longitudinal edges 7*a*, 8*a* of the blanks 7', 8' and/or parallel to the guiding means 28, 29 of the guiding devices. Consequently, the supporting surfaces for the longitudinal edges 7*a*, 8*a* of the blanks 7', 8' are in this case formed in the upper area of each of the rods 32, 33. The diameter of the rods 32, 33 may further be very small compared to the width of the folding shafts 25, so that the latter can be positioned very closely together. The rods 32, 33 may advantageously be fixed to a shared carrier 34 (FIGS. 2 and 3), which can be lifted and lowered in a controlled manner to carry out the joint lifting H of the rods 32, 33. Furthermore, it can be advantageous that the free ends of the rods 32, 33 taper to ensure reliable transfer of the blanks 7', 8', in particular of the lower blank 7', to the guiding surfaces of the rods 32, 33.

Figure 5:
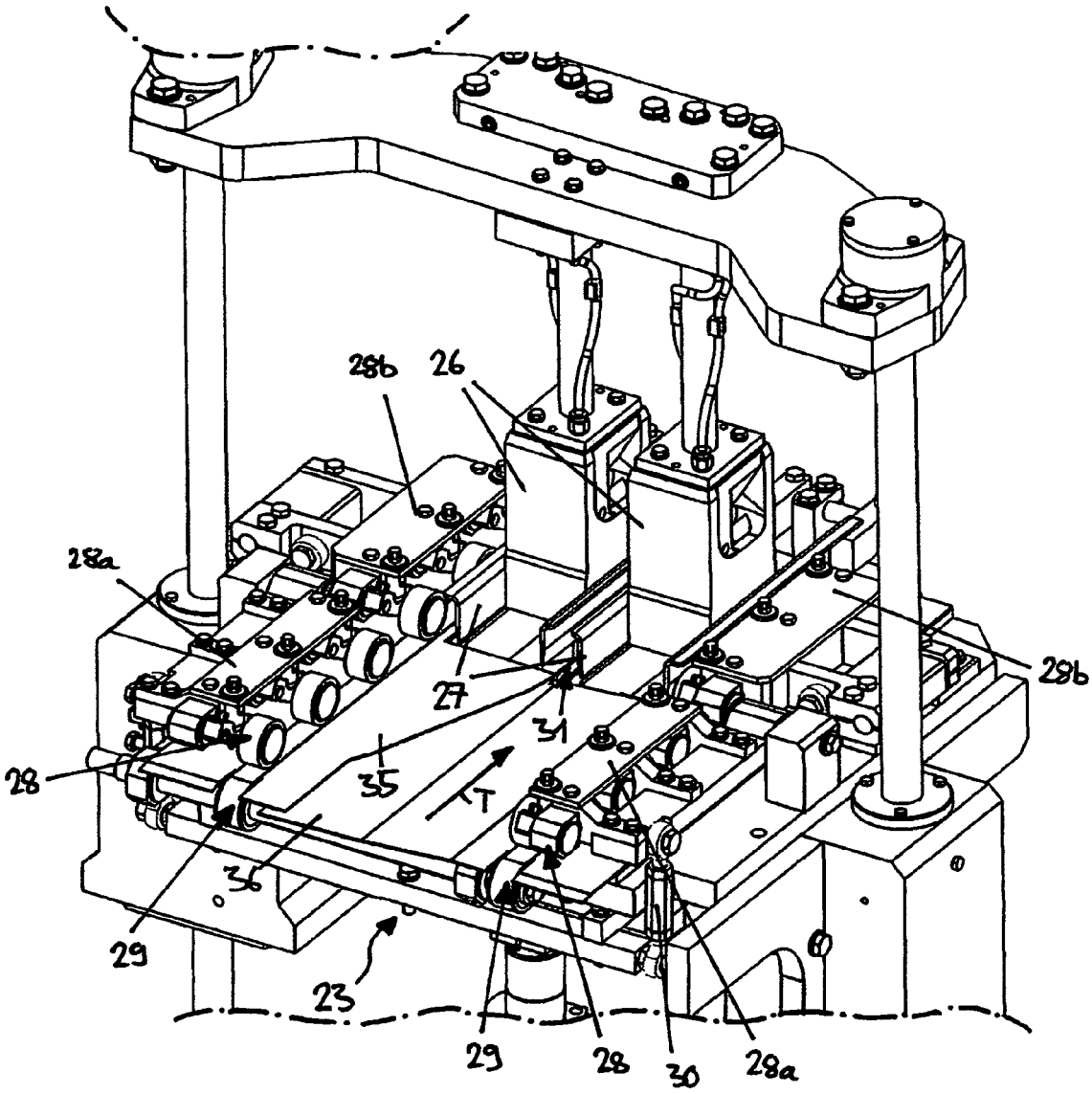
FIG. 5 shows a perspective view of the part of the device which is disposed downstream of the transverse cutting device, including the transport device, the lifting means and the folding shafts.

As can be seen from FIG. 5, it can be advantageous for the same purpose that guiding surfaces 35, 36 are disposed upstream of the lifting means 31 which extend between the guiding means 28, 29 of the guiding devices and are structured and disposed to feed the overlapping longitudinal edges facing each other 7*a*, 8*a* in the blanks 7', 8' to their respective supporting surfaces of the lifting means 31—in this case the surface of the respective rods 32, 33. In the embodiment shown in FIG. 5, the guiding surfaces 35, 36 are formed, for example, by two plate elements disposed on top of each other, one of which—the lower one—36, for example, runs slightly tilted from one of the guiding devices (the right one in FIG. 5) 28, 29 at least as far as the lower rod 32 (FIGS. 2 and 3) of the lifting means 31, and preferably beyond that, while the other—upper—one 35, which has an inward-facing section, runs from the other guiding device 28, 29 (the left one in FIG. 5), for example, as far as the upper rod 33 (FIGS. 2 and 3).

The operation of the device will be described in more detail below based on a method for packaging, paste-like product portions in a wrapper.

When packaging material is needed, the motor 3 starts in order to unwind packaging material 5 from the roll of packaging material 2 by rotation of the take-off roller 4. This process continues as long as there is a need for packaging material, in particular as detected by the packaging material buffer 18. While the web of packaging material 5 is advancing over the take-off roller 4, the web of packaging material 5 is simultaneously separated lengthwise in the middle by means of the rotating blade of the cutting device 6 to yield two parallel webs of packaging material 7, 8. Further along the webs of packaging material 7, 8 moving towards the folding shafts 25, seen in the direction of transport T, the webs 7, 8 continue to run parallel, but the longitudinal edges facing each other 7*a*, 8*a* are aligned to overlap by guiding each of them over its associated deflecting axle 10, 11 of the adjusting unit 9, disposed parallel to each other, while deflecting them—in this case by about 90°—if the deflecting axles are disposed at an angle of about 45° relative to the webs 7, 8. After this deflection, the webs 7, 8 have reached their final position relative to the folding shafts 25 and/or relative to the subsequent format of the product. They then reach the packaging material buffer 18 and, upon leaving it, come between the rollers 21, 22 of the advance means or conveyor 20. The latter transfers the webs 7, 8 intermittently, in accordance with the desired length of the wrappers, which is based on the desired packaging format, from the packaging material buffer 18 over the cutting device 24 to the area of the transport device 23. The guiding means 28, 29 of the guiding devices are open, i.e. spaced from each other, and accommodate one web 7, 8 each between them. After the webs 7, 8 have been pulled forward in this manner, the guiding means 28, 29 are closed by shifting, for example, the rolls of the upper guiding means 28 against the carrying run of the circulating conveyor belt of the lower guiding means 29. The two webs 7, 8, which have already been aligned relative to each other by means of the adjusting unit 9, have thereby been frictionally engaged by the respective guiding devices clamping them between the guiding means 28, 29 in accordance with their desired length. The webs 7, 8 are then separated transverse to their overlapping longitudinal edges 7*a*, 8*a* while the substantially flat blanks 7', 8' of the wrappers are created by operating the cutting device 24.

The guiding means 28, 29 are then set in motion to transfer the blanks 7', 8', wherein in particular only one of the guiding means, for example the lower guiding means 29 disposed as a belt, is set in rotation while the rolls of the upper guiding means 28 are thereby passively moved oppositely. During the entire transport process, the blanks 7', 8' remain clamped between the guiding means 28, 29, ensuring that they are guided linearly in frictional engagement above the folding shafts 25 until they have reached their folding position as apparent from FIGS. 1, 3, and 4. Furthermore, the section of the overlapping longitudinal edges facing each other 7*a*, 8*a* in the blanks 7', 8' located between the guiding devices is guided over the guiding surfaces 35, 36 (FIG. 5) during this transport process (wherein one of the blanks 8 is deflected slightly downward relative to the other 7 in the present case) to feed it to the supporting surfaces of the rods 32, 33 of the lifting means 31 which are disposed on top of each other. The blanks 7', 8' have reached their folding position as shown in FIGS. 1, 3, and 4. The longitudinal edges facing each other 7*a*, 8*a* in the overlapping blanks 7', 8' are subsequently lifted by the lifting means 31 at the guiding devices (whose guiding means 28, 29 clamp the respective blanks 7', 8' between them but are stationary) in continuous frictional engagement at least to a level H where the loose ends of the longitudinal edges facing each other 7*a*, 8*a* are outside of (or no longer inside) the area of the respective neighboring folding shafts 25, wherein each of them is separately supported by the separate supporting surface of the respective rods 32, 33 disposed on top of each other. At the same time, potential kinks or creases in the blanks 7', 8', held in frictional engagement between the guiding means 28, 29, are smoothed during this lifting operation.

The folding stamps 26 (FIGS. 2 to 5), located in their upper position above the folding shafts 25, then start descending into the folding shafts 25, wherein the blanks are released by releasing the frictional engagement—preferably when or immediately before the folding stamps 26 meet the blanks of packaging material 7', 8'—by shifting the upper guiding means 28 away from the lower one 29. The blanks 7', 8' are thereby folded into the folding shafts 25 while the folding stamp 26 descends continuously and thus forms an upwardly open wrapper each time, whereupon the folding stamps 26 are shifted back into their upper position above the folding shafts 25.

The upwardly open wrappers can then, for example, be placed in a cell and successively transferred to further processing stations (not shown), where they are filled with the paste-like product portion, whereupon the wrapper is closed by folding the sections protruding upwardly beyond filling level inward over the filling material so that the sections overlap and in particular the filling material is completely enclosed. The finished wrapper packs can finally be removed from the device at a removal station.

Although the previous description of one embodiment of the invention with reference to the drawings relates to packaging products that are paste-like at least at the time when they are made into portions, such as butter or margarine, it is evident to the expert that the invention is also suitable for packaging other product portions in any state of aggregation, including solid products, which can be supplied to the upwardly open wrappers individually or in congregation, wherein the same advantages in accordance with the invention can be achieved regardless of the consistency of the material to be packaged.

I claim:

1. A method for packaging product portions in a wrapper, wherein at least two webs of packaging material are transported towards an upwardly open folding shaft, the method comprising the steps of:

a) aligning the two webs of packaging material in a substantially parallel manner, wherein adjacent longitudinal edges of the two webs overlap;

b) cutting the webs in a direction transverse to their overlapping longitudinal edges to create substantially flat wrapper blanks;

c) guiding and supplying the blanks in frictional engagement to dispose the blanks above the folding shafts;

d) lifting together the adjacent longitudinal edges of the overlapping blanks to at least a level where adjacent loose ends of the longitudinal edges of the blanks are outside of an area of a respective neighboring folding shaft;

e) releasing the frictional engagement of the blanks;

f) inserting a folding stamp into the folding shaft thereby folding the blanks into the folding shaft to create an upwardly open wrapper;

g) placing the product portion on the upwardly open wrapper; and h) turning upwardly protruding sections of the wrapper inwardly while overlapping same.

2. The method of claim 1, wherein, after the webs have been aligned relative to each other, the webs are grasped in frictional engagement in accordance with a desired length of the blanks, severed transverse to the longitudinal edges of the webs to create the blanks and subsequently guided to their folding position in continuous frictional engagement.

3. The method of claim 1, wherein frictionally engaged guiding and/or the frictionally engaged grasping of the blanks and/or the webs is carried out by clamping them between conveyors disposed above and below the webs.

4. The method of claim 1, wherein each of the adjacent overlapping longitudinal edges of the blanks is supported separately when being lifted together.

5. The method of claim 4, wherein the adjacent longitudinal edges of the blanks are lifted by a lifting means with separate supporting surfaces, wherein each of the longitudinal edges of the blanks is fed to a respective supporting surface.

6. The method of claim 5, wherein the longitudinal adjacent edges of the blanks are fed to supporting surfaces of the lifting means while being disposed on top of each other.

7. The method of claim 1, wherein the substantially parallel alignment of the webs, whose adjacent longitudinal edges overlap, is achieved by deflecting each of two parallel webs over one respective deflecting axle, the deflecting axles being disposed parallel to each other and having an angle greater than 0° and smaller than 90° relative to the longitudinal edges of the webs.

8. The method of claim 7, wherein the webs are created by lengthwise severing one single web of packaging material, wherein said angle is between 30° and 60°.

9. A device for packaging product portions in a wrapper, wherein at least two webs of packaging material are transported towards an upwardly open folding shaft, the device comprising:

means for aligning the two webs of packaging material in a substantially parallel manner, wherein adjacent longitudinal edges of the two webs overlap;

means for cutting the webs in a direction transverse to their overlapping longitudinal edges to create substantially flat wrapper blanks;

means for guiding and supplying the blanks in frictional engagement to dispose the blanks above the folding shafts;

means for lifting together the adjacent longitudinal edges of the overlapping blanks to at least a level where adjacent loose ends of the longitudinal edges of the blanks are outside of an area of a respective neighboring folding shaft;

means for releasing the frictional engagement of the blanks;

means for inserting a folding stamp into the folding shaft thereby folding the blanks into the folding shaft to create an upwardly open wrapper;

means for placing the product portion on the upwardly open wrapper; and means for turning upwardly protruding sections of the wrapper inward while overlapping same.

10. The device of claim 9, wherein the device comprisis two upwardly open folding shafts disposed next to each other, each having a respective folding stamp, wherein the guiding and supplying means comprises two parallel guiding devices spaced apart from each other in a transverse direction, each having two guiding means disposed on top of each other, which are structured and disposed to accommodate the blanks in frictional engagement between them and to release them, wherein said lifting means is disposed between the folding shafts and is structured to support the adjacent overlapping longitudinal edges of the blanks, wherein said lifting means can be shifted between a lower position below the longitudinal edges to a respectively higher position.

11. The device of claim 10, wherein said guiding and supplying means and said guiding devices are disposed immediately downstream of said cutting means.

12. The device of claim 10, further comprising a conveyor operated in a controlled manner to transfer the webs to the cutting means and to the guiding and supplying means.

13. The device of claim 10, wherein at least one of said guiding means is a circulating conveyor belt.

14. The device of claim 13, wherein a lower guiding means comprises said conveyor belt.

15. The device of claim 10, wherein at least one of said guiding means has several conveyor rollers.

16. The device of claim 15, wherein an upper guiding means comprises said conveyor rollers.

17. The device of claim 10, wherein only one of said guiding means or a lower guiding means is operated in a controlled manner, while an other guiding means is passive.

18. The device of claim 10, wherein one of said guiding means or a lower guiding means is stationary while an other guiding means can be shifted between a gripped position, in which it seats closely against the other guiding means, and a release position, in which it is spaced apart from the other guiding means.

19. The device of claim 10, wherein said lifting means has two separate supporting surfaces to each of which one of the adjacent overlapping longitudinal edges of said blanks can be fed.

20. The device of claim 19, wherein said supporting surfaces are disposed on top of each other.

21. The device of claim 19, wherein said lifting means comprises rods, wherein said rods extend parallel to said longitudinal edges of the blanks.

22. The device of claim 19, further comprising guiding surfaces disposed between said guiding devices upstream of said lifting means to feed the adjacent overlapping longitudinal edges of the blanks to a respective supporting surface of said lifting means.

23. The device of claim 10, wherein said aligning means is disposed upstream of said guiding and supplying means or upstream of said cutting means.

24. The device of claim 10, wherein said aligning means comprises deflecting axles, each allocated to one of the webs, which are disposed parallel to each other and have an angle greater than 0° and smaller than 90° or between 30° and 60°, relative to longitudinal edges of the webs.

25. The device of claim 24, wherein a distance between said deflecting axles can be changed to enable changing an alignment of the webs relative to each other.

26. The device of claim 10, further comprising a cutting device acting parallel to the longitudinal edges of the webs and structured and disposed to lengthwise sever a single web of packaging material fed to said cutting device to create parallel webs, said cutting device being disposed upstream of said aligning means.

* * * * *